United States Patent [19]

Fischer

[11] 4,426,074

[45] Jan. 17, 1984

[54] SWITCH FOR THE DIVERSION OF SPOILED ITEMS FROM AN OVERLAPPED STREAM OF PAPER PRODUCTS

[75] Inventor: Emil Fischer, Ludwigshafen-Oggersheim, Fed. Rep. of Germany

[73] Assignee: Albert Frankenthal AG, Fed. Rep. of Germany

[21] Appl. No.: 284,610

[22] Filed: Jul. 20, 1981

[30] Foreign Application Priority Data

Jul. 31, 1980 [DE] Fed. Rep. of Germany ..... 3029154

[51] Int. Cl.[3] ..... B65H 29/62

[52] U.S. Cl. ..... 271/302; 198/369; 209/925

[58] Field of Search ..... 271/302, 303, 305, 296, 271/202; 198/369, 366, 370, 459; 209/698, 925, 656, 606, 900

[56] References Cited

U.S. PATENT DOCUMENTS

| | | | |
|---|---|---|---|
| 2,649,182 | 8/1953 | Parker | 271/302 X |
| 3,433,476 | 3/1969 | Baucke | 271/303 X |
| 3,717,249 | 2/1973 | Faley | 271/302 X |
| 3,776,546 | 12/1973 | Erickson et al. | 271/303 |
| 3,911,800 | 10/1975 | Feldkamper | 271/202 X |
| 4,235,434 | 11/1980 | Muller | 271/305 X |
| 4,315,621 | 2/1982 | Snellman | 271/302 X |

FOREIGN PATENT DOCUMENTS

| | | |
|---|---|---|
| 1411783 | 11/1968 | Fed. Rep. of Germany . |
| 1761726 | 4/1971 | Fed. Rep. of Germany . |
| 2229414 | 7/1975 | Fed. Rep. of Germany . |
| 2820877 | 12/1978 | Fed. Rep. of Germany . |
| 2848010 | 1/1980 | Fed. Rep. of Germany . |

*Primary Examiner*—Bruce H. Stoner, Jr.
*Assistant Examiner*—James Barlow
*Attorney, Agent, or Firm*—Allison C. Collard; Thomas M. Galgano

[57] ABSTRACT

A switch system for clearing spoiled items from an overlapped stream of paper products such as signatures has a three-flight conveyor belt transporting system whose middle flight may be rocked bodily so that its downstream belt support roll, functioning as a switch roll, is moved between an upper position in which it is leveled up with the next flight, and a lowered position for sending the stream, when made up of spoiled items, downwards under the next flight to a separate delivery. The side face of the upstream belt roll of this same next flight is covered by a cover for neatly separating the stream and switching it over into the downward parts under this next flight. Over the switch a backer roll is placed so as to have its weight supported on the stream of products (in turn supported by the switch roll). In this way the products are well gripped and controlled.

8 Claims, 2 Drawing Figures

FIG 1
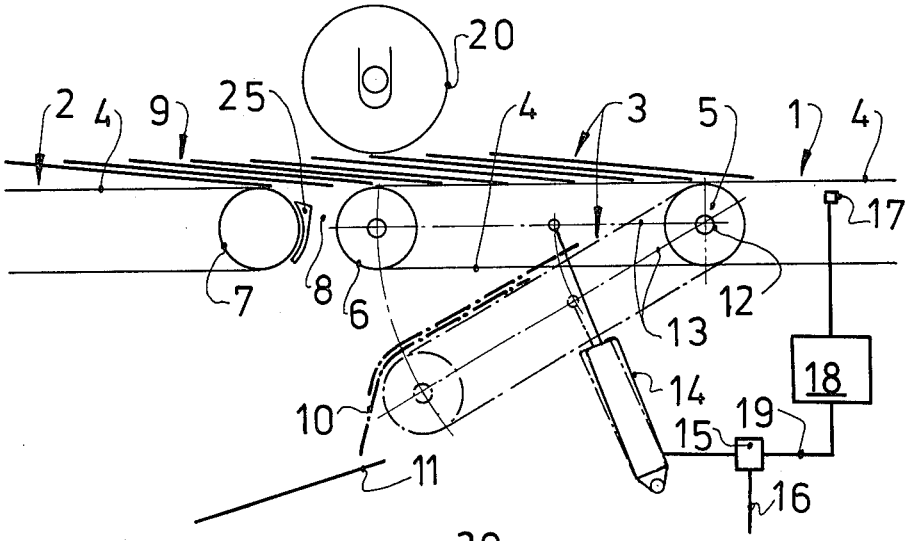
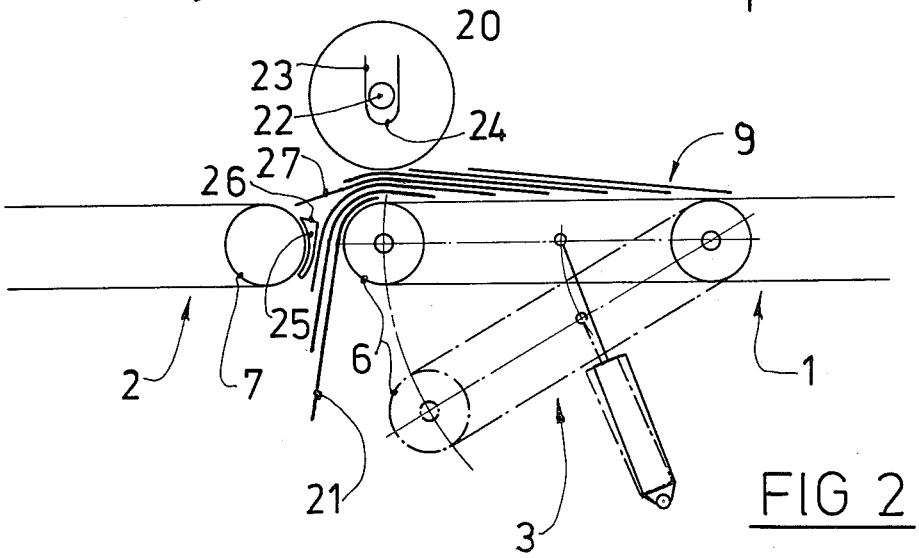
FIG 2

SWITCH FOR THE DIVERSION OF SPOILED ITEMS FROM AN OVERLAPPED STREAM OF PAPER PRODUCTS

BACKGROUND OF THE INVENTION (i) Field to Which Invention Relates

The present invention is with respect to a switch for diverting spoiled items from an overlapped stream of folded paper products such as signatures and more specially coming from a folding machine and being forwarded to a delivery station, the folded signatures being supported on a transport system made up of a number of conveyor belt flights which are placed end to end and are made up of belts running round belt support rolls. At least the downstream roll of two belt rolls of a conveyor flight placed between two further conveyor flights is able to be moved bodily as a switch roll by way of a driving part under the control of a control unit, so that the distance from the switch roll from the next conveyor flight is changed.

(ii) The Prior Art

In a known system on these lines the space between one conveyor belt flight and the next one may be changed for forming a switch system or diversion by making the downstream conveyor belt flights shorter or longer. To do this, the downstream belt support roll of this upstream conveyor belt flight is moved backwards and forwards while keeping at the same level. For taking care of the change in length, that is to say without stretching the belts, the belts have their lower runs guided over a take-up roll which may be moved bodily and which is moved backwards and forwards in the opposite direction to the bodily moved belt support roll. The change in overall length of the conveyor belt flight to make it longer or shorter and for this reason the change in position of the belt support roll and of the guide or take-up roll has to take place very quickly for neatly separating a part of the stream of overlapped signatures, which is in order, from a further part, in which the signatures are spoiled. For this reason high inertia forces come into play so that the system may only be worked with sharp jerks and there is a high wear rate. At the same time, the driving system has to be designed with a large size and a high power so that the switch system is made higher in price and more complex. A further point is that the loop of belt needed on changing the length of the belt and run round the take-up roll takes up much space, quite in addition to the more complex mechanical design of the machine necessary for the take-up roll and the direction changing rolls near it at the ends of the conveyor flight. Furthermore, because the belts are changed in direction so many times, their working life is made shorter.

In the case of a further known system (see German Auslegeschrift specification No. 2,229,414) for forming a switch there is a plunging spade placed over the overlapped stream of signatures so that is may be moved for pushing its spade edge between one signature and the next one so as to have the effect of forwarding the signatures running onto it to a downstream belt system. In the case of this system as well, the plunging spade has to be sharply moved and speeded up and the downstream belt system for taking up the separated or diverted signatures has to be suddenly speeded up to make certain of neatly diverting the overlapped stream, so that high inertia forces come into play and the system is generally moved in sharp jerks causing a high wear rate. It is furthermore likely for the plunging spade to be run up against a folded signature so that the signatures coming thereafter have to be moved thereover and a pile-up is likely. Even in addition to this, the system for driving and movingly supporting the plunging spade and the belt system used therewith is very complex from the engineering point of view.

In the case of a further known system (see German Auslegeschrift specification No. 2,848,010) a conveyor belt flight has a generally thick downstream belt support roll which is used with a further short conveyor belt flight placed thereover and supported on a rocking frame, said short flight being able to be moved, for forming a switch, about its upstream belt roll (which is placed resting against the thick front belt roll) into a higher-up and further-back position, said belt roll being able to be drivingly joined up with a separating roll, which may be moved into a position between one folded signature and the next one. In the normal transport position of the signatures the said thick downstream belt roll and the short belt flight used therewith are placed on the two sides of an S-like transport way with the purpose of causing a certain fanning of the folded signature forced through this S-like way of opening. A shortcoming is however that because of the change in direction of the overlapped stream along a letter S, a heavy force is produced acting on the signatures and may be the cause of undesired creasing and the like of thick signatures when there is a small overlapping distance. Furthermore the printing ink, which is still soft, on the work may be smeared. For this reason this known system is not able to be used for high press speeds.

OVERVIEW OF THE INVENTION

Taking this prior art as a starting point one purpose of the present invention is that of overcoming the undesired effects of the prior art and designing a switch for spoiled items in a stream of overlapped signature or other products which makes possible a generally high running speed of the transport belt and nevertheless may be changed over from one position of switching to the other slowly and for this reason generally smoothly. Furthermore the system is to be simple in design and troublefree in operation.

For effecting this purpose and still further purposes in the invention the switch roll, which may be changed in its position, may be rocked about a fixed-axis belt roll, forming part of the same conveyor belt flight as the switch roll, in a downward direction, and when the switch roll is in its normal position lined-up with the conveyor belt flight next to, it has the effect of pushing the overlapped stream of signatures against a freely supported backer roll placed over it. Furthermore there is a cover covering over the part of the belt support which is on the downstream side of the space between the switch roll and the next conveyor belt flight.

The rocking conveyor belt flight produced in such a system has the useful property that when the rocking belt flight is moved out of its normal running position, the folded signatures thereon are simply moved past, and diverted clear of, the next conveyor belt flight onto a special spoiled items delivery. In this respect the belt length is kept the same in every position of rocking, this being a useful effect insofar as no belt takeup systems are necessary for changing the length of the flight. Furthermore the spoiled items to be diverted are not lifted clear of the conveyor belt flight but are simply pushed down over the downstream belt support roll of the rocking belt flight. No moving parts such as plunging spades, separating shafts or the like are for this reason necessary in the system. When the rocking conveyor belt flight is moved back into its starting or normal position, the backer roll used with the switch roll makes certain that the folded signatures, which are still in the space between the rocking conveyor belt flight and the next conveyor belt flight, as the rocking flight is moved back, go on being transported in this direction without any trouble conditions. At the same time the cover of the upstream belt roll of the downstream belt flight and placed in the space between the two flights makes certain that these products, which are still to be diverted, are not moved in an undesired direction. The measures which have been noted for this reason make certain there is no chance of any pile-up. Because of such measures the rocking motion may, with useful effect, takes place at a generally low speed so that there is not only operation free of jerks but furthermore generally simple driving systems are possible. The useful effects produced with the invention are for this reason to be seen, more specially, in very low running and other costs.

A useful effect is produced if the cover used for the belt roll on the downstream side of the inbetween space takes the form of a guide wedge becoming narrower in a downward direction and which is more specially curved to be in line with the form of the belt support roll next thereto. The outcome of such measures is a fixed separating part of good effect which, on the rocking belt flight being moved back into its starting position, comes into a position between one signature and the next one (that is to say one signature moved along one side of it and the next one along the other), a top broad side of the cover or guide wedge forming a support, over which the first item coming after the diversion may be safely guided onto the next conveyor belt flight. On the other hand it is possible to make certain that the items, which have been moved against and guided along the long side or downwardly running side of the guide cover are moved on further without any pile-up.

As a part of a further useful development of the general teachings of the invention the switch roll, able to be moved upwards and downwards, may be supported on a rocking frame which may be moved bodily by a driving cylinder. Even though the belt flights may be rocked, the belts are nevertheless supported in a simple way.

LIST OF FIGURES

Further useful developments and outgrowths of the general teachings of the present invention will be seen from the account, now to be given, of one working example using the figures, and from the dependent claims.

FIG. 1 is a side view of the transport system of the present invention with the switch in its shut and open positions to make clear the effect on the overlapped stream of printed products or signatures.

FIG. 2 is a side view of the transport system of the invention to make clear the motion of the stream of lapped signatures on shutting the switch.

DETAILED ACCOUNT OF WORKING EXAMPLE OF THE INVENTION

The transport system placed between the delivery fan wheel or spider of a folding machine and a downstream delivery station as for example a parcel delivery station, is, as is normally the case, made in a number of conveyor belt flights, this being necessary in view of past experience in the art. The main details of the structure and design of such a transport system are in fact known so that no account thereof is needed on the present case. In FIGS. 1 and 2 two spaced conveyor belt flights 1 and 2 may be seen which are joined together or bridged over by a conveyor belt flight 3 which may be rocked bodily. Conveyor belt flights 1, 2 and 3 are made up of spaced parallel separate belts 4 running in each case round the downstream and an upstream belt support roll. The downstream belt support roll 5 of the conveyor belt flight 1 at the fan wheel or spider end of the system is at the same time the upstream belt support roll of the rocking conveyor belt flight 3 so that there is generally speaking a very smooth forwarding of the signatures from the upstream conveyor belt flight 1 to the downstream conveyor belt flight 3, that is to say without any spaces between the flight. The downstream belt support roll 6 of the rocking conveyor belt flight 3 is separate from the upstream conveyor belt roll 7 of the next conveyor belt flight 2 and spaced therefrom so that between the two belt support rolls 6 and 7 there is a small space 8 therebetween. As long as belt support roll 6 is lined up or leveled up with the next belt support roll 7 this inbetween space is however so small that the stream of overlapped signatures 9 produced by the fan delivery wheel may be run thereover smoothly.

In the case of a wheel or roll feed rotary printing press, for undertaking a "flying paster" on changing rolls of paper, lengths of paper taken from the rolls used are simply pasted together. The pasted join, which is colored so that it may be seen on the webs, is responsible for signatures or other products produced therefrom being spoiled so that such items have to be diverted from the overlapped stream of signatures. For this purpose, in the present invention, the rocking conveyor belt flight 3 with its downstream switch roll 6 is rocked bodily of the position in which it is in line with the fixed-position conveyor belt flights 1 and 2, this position being marked in full lines in the figures, downwards till the overlapped stream 9 is cut off and diverted between the belt support rolls 6 and 7 and the items upstream from this point are guided out downwards over switch roll 6 of the rocking conveyor belt flight 3 so that such items go to a separate delivery. The lower rocked position of the rocking conveyor belt flight 3 is marked in chained lines in FIGS. 1 and 2, the items 10 coming out by way of switch roll 6 simply running down a chute placed under switch roll 6 and into a box (not figured) for spoiled items.

The downstream switch roll 6, which may be moved bodily, of the rocking conveyor belt flight 3, which may be lowered, is moved through a part-circle centered on the shaft 12 of the upstream belt support roll 5 (whose axis is fixed in position) of rocking flight 3. To make this possible there is a rocking frame 13 supported for rocking motion centered on axis 12 and used for supporting the downstream switch roll 6, such rocking frame 13 being used, as desired, at the same time for supporting the belts 4 of the upstream flight 1. The rocking frame 13 is moved by a driving cylinder 14 having its one end supported on the housing of the system and having its piston rod turningly joined with the rocking frame. Driving cylinder 14 may be an air-powered cylinder supplied by way of a pressure line 16 controlled by a valve 15, the air power supply not being figured. For putting driving cylinder 14 into and out of operation, valve 15 is worked by a control unit which is placed over or under (in the present case under) the overlapped stream 9 of signatures, the control unit having a sensor 17 put into operation by the colored marking at the pasted join in the signatures. The signal from sensor 17 goes through a unit 18 in which it is processed so that after such processing the signal is produced at output 19 for operation of valve 15. Sensor 17 may for example be a photoelectric cell whose electric output signal is so much amplified by processing unit 18 that the coil of a solenoid of valve 15 may be worked thereby. Driving cylinder 14 may be run at a speed which is very much lower than the speed of the belts so that smaller inertia forces come into play and the power needed for the cylinder is lower. Sensor 17 of the control system is best so placed that it gives an early warning of the start of the spoiled signatures and the end thereof. Because the overlap stream 9 is more quickly cut off or diverted on lowering conveyor belt flight 3 than the cutting of the stream back into the inline position, a delay unit may be present (not figured) so that the signal marking the start of spoiled signatures is only handed on after a certain delay. The top and lower ends of rocking motion of rocking frame 12 are best limited by stops.

Over the switch (or downstream) belt support roll 6 of the rocking conveyor belt flight 3 there is a backer roll 20 against which in the normal, in-line position of the rocking or switching conveyor belt flight 3, that is to say in line with the two conveyor belt flights 1 and 2 next to it, the transported overlapped stream of signatures is pressed by switch roll 6, of switching conveyor belt flight 3. Because of this, between backer roll 20 and switch roll 6 the overlapped stream 9 is well gripped and almost positively moved forwards, this being responsible for a useful effect on return motion of the rocking conveyor belt flight 3 (after the same has been lowered) into its normal in-line position, this being best seen from FIG. 2. When the downstream or switch belt transport roll 6 of rocking conveyor belt flight 3 is moved downwards at a generally slow speed about the fixed-position axis 12 of the upstream belt support roll 5 of conveyor belt flight 3 into a position in which the downstream end or "edge" of conveyor belt flight 3 is still in the space 8 between flights 3 and 2, the turned and diverted items (marked at 21 in FIG. 2) are positively and safely guided because of the positive guiding effect of backer roll 20 so that there is no danger of any smash-up, pile-up or stoppage. Backer roll 20 is freely rested on the overlapped stream 9 of signatures so that when switch roll 6 of switching conveyor belt flight 3 comes back into its upper position, it is lifted somewhat so that its full weight is resting on the signatures to be transported, its weight being taken up by the belts and the switch roll 6 thereunder. For increasing the backing up effect of backer roll 20 the same may have a spring, so that in this case the backer roller 20 may be made lighter. In the working example presently addressed the backer roll 20 has its end bearing pins 22 guided in guides 23 running in the direction of lifting and lowering, there being a stop 24 at the lower ends of the guides in each case. In the present case such guides may be simple U-like parts of loops taking up the bearing pins 22. Guides 23 are fixed to the frame of the transport system so that the lower position of backer roll 20 is fixed in relation thereto. The frame which at the same time is used for bearing the belt rolls with fixed axes and supporting the lower end of driving cylinder 14, is not to be seen in the present figures in order to make them more straightforward.

In FIG. 2 it will be seen that a cover 25 is present covering over the belts on the belt roll 7 over which the belts are run from the lower run of belt flight 2 to the top run thereof. This cover 25 is for stopping items as at position 21 running up against the belts of flight 2 on the belt support roll 7 when the rocking conveyor belt flight 3 is changed over between its top and lower position. In the present working example addressed this cover is made with a downwardly decreasing thickness and with a curved form so as to be parallel to the belt support roll 7, and the cover takes up little space. The top end face of the cover or guiding wedge takes the form of a useful top support face 26 for guiding the lead edge of the first signature 27 or item which is not pushed into the space 8, of the oncoming overlapped stream on guide 2 and the signatures or other products are supported by this top face of the cover at the start of a lowering motion of the switch roll 6. The wedge-like cover 25 is for this reason useful for two purposes, on the one hand functioning as a fixed separating wing which, when the belt flight 3 is moved upwards will have one signature passing down its side in a downward direction while the next signature after this will be run over the top face 26, or, putting it somewhat differently, the edge of the cover formed between the top face 26 and the side face of the cover will be between one signature and the next one so that the part of the overlapped stream 9 of spoiled items will be neatly separated from the further part of the overlapped stream which is not made up of spoiled items and is to be forwarded onto conveyor flight 2. Backer roll 20 is the cause of a certain fanning of the signatures so that it is easier for the cover 25 to be responsible for separating one spoiled signature from the next one, as may best be seen from FIG. 2.

I claim:

1. In a switch for diverting spoiled items from a transport system for conveying a continuous overlapped stream of paper products, said system being made up of an upstream first conveyor belt flight, a middle second conveyor belt flight and a downstream conveyor belt flight, said conveyor belt flights having belts and upstream and downstream ends and being placed end to end with the middle conveyor belt flight between the first and third conveyor belt flights, said middle conveyor belt flight having an upstream roll at its upstream end and a downstream switch roll at its downstream end, at least said switch roll of said middle conveyor belt flight being able to be moved bodily for an item diverting function in which the distance of said roll from said third flight is changed, said system furthermore having a driving unit for bodily moving said switch roll, the invention residing in that said system has a free backer roll placed over said switch roll at such a level that when said switch roll is in an upper position for handing on all product items to said third conveyor flight said switch roll is responsible for supporting and pushing said overlapped stream against said backer roll, and a cover covering the end of the belt of said third conveyor flight where this belt is to be moved upwards from a lower run of said third flight to an upper run thereof, said motion of said switch roll bodily out into a diverting position being designed to take place by turning said switch roll bodily through a part-circle centered on said middle conveyor flight's upstream belt supporting roll.

2. The structure as claimed in claim 1 having a guide stretching in the direction of lowering and lifting, said backer roll being supported in said guide, a stop at a lower end of said guide for limiting downward motion of said backer roll, the level of said stop being such that in the upper position of said switch roll with an overlapped stream of product items running between said switch roll and said backer roll the last-named is a small distance over and clear of said stop.

3. The structure as claimed in claim 2 having bearing pins on said backer roll, said guide being made up of two U-like parts each with one of said bearing pins placed therein.

4. The structure as claimed in claim 1 wherein said cover becomes thinner in a downward direction.

5. The structure as claimed in claim 4 wherein said cover is curved so as to be in line with the curved form of the upstream end of the said third flight.

6. The structure as claimed in claim 1 having a rocking frame supporting said switch rolls and having a driving cylinder for rocking said frame.

7. The structure as claimed in claim 1 wherein at the downstream end of said first flight its belt is run round said upstream roll of said middle flight.

8. A conveyor system for signatures in a continuous overlapped stream having three conveyor belt flights, namely a first upstream conveyor belt flight, a third conveyor belt flight and a second conveyor belt flight placed therebetween for taking up signatures from a downstream end of the first conveyor belt flight and forwarding them to an upstream end of said third conveyor belt flight, an upstream roll and a downstream switch roll for supporting said middle conveyor belt flight, a control unit and a driving unit controlled thereby for moving said switch roll bodily and so changing its distance from an upstream end of said third conveyor belt flight, such bodily motion of said switch roll taking place in a part-circle about said second conveyor belt flight's upstream roll, and being between an upper switch roll position for forwarding all signatures coming onto said middle conveyor belt flight onto said third conveyor belt flight, and a lower switch roll position in which signatures are guided downwards between said second and third conveyor belt flights, a backer roll placed over said second roll so that said overlapped stream of signatures may be pushed against a lower face of said backer roll when said switch roll is in its said upper position, and a cover, covering an upstream end of said third conveyor belt flight where the belt of the same is run upwardly from a lower run to an upper run of said third flight.

* * * * *